United States Patent [19]

Schick

[11] 3,937,326

[45] Feb. 10, 1976

[54] PRODUCT DISPLAY CARTON

[76] Inventor: Andre Schick, Chemin du Martinet 5 bis, 1016 Lausanne (Vaud), Switzerland

[22] Filed: July 5, 1974

[21] Appl. No.: 486,061

[30] Foreign Application Priority Data

July 18, 1973 Switzerland ..... 10611/73

[52] U.S. Cl. ..... 206/465; 206/467; 220/306; 220/352

[51] Int. Cl.[2] ..... B65D 73/00

[58] Field of Search ..... 206/461, 464, 465, 467; 220/305, 306, 309, 352, 353; 229/16 C, 43

[56] References Cited

UNITED STATES PATENTS

| | | | |
|---|---|---|---|
| 2,833,405 | 5/1958 | Nero | 206/464 |
| 3,351,188 | 11/1967 | Vajtay | 229/43 |
| 3,371,848 | 3/1968 | Ward et al. | 229/45 |
| 3,767,110 | 10/1973 | Congleton | 229/45 |
| 3,795,360 | 3/1974 | Bianchi et al. | 229/43 |

FOREIGN PATENTS OR APPLICATIONS

| | | | |
|---|---|---|---|
| 662,471 | 5/1963 | Canada | 206/465 |

*Primary Examiner*—William Price
*Assistant Examiner*—Bruce H. Bernstein
*Attorney, Agent, or Firm*—Emory L. Groff, Jr.

[57] ABSTRACT

A blister type display carton includes a base sheet provided with fold lines adjacent its edges to permit the edges of the sheet to be folded up and provide the side walls of the carton. A transparent blister cover has a plurality of depending tongues on its side edges and the tongues engage in related slots in the side walls of the carton to attach the cover to the base sheet.

3 Claims, 18 Drawing Figures

PRODUCT DISPLAY CARTON

The present invention relates to is a display carton formed essentially of a cardboard base which supports a product and blister-lid adapted to the shape of the carton.

Stands for the display of goods in shops are well known, and usually consists of a cardboard base covered with a transparent protecting cover.

There are also stands consisting of a cardboard base covered with a plastic protective top, called a blister.

The drawback of these kinds of stands is that the blister has to be welded or glued onto the cardboard base. As a result, this leads, in the case of welding, to tooling costs and when it is desired to take the product out of the carton, the blister is very difficult to remove and the product risks being damaged.

The object of the present invention is to avoid these drawbacks and a product display carton. Which is characterised by the fact that it comprises a base sheet, a blister adapted and assembled to the shape of the base sheet, the base sheet being provided with fold lines for turning up the edges of said sheet and slots for receiving the blister fixing tongues, said tongues also fitting into the corresponding slots on the base sheet.

The attached drawing shows three forms of execution of the display carton, comprising the object of the invention, illustrated by way of example.

FIG. 1 is a vertical section, along the line 1—1 on FIG. 2, of a cardboard base sheet, the turned up edges of the sheet being shown by a chain-dotted line.

FIG. 2 is a top plan view of the base sheet shown in FIG. 1.

FIG. 3 is an end view of the sheet with the same representation of the turned up edges as in FIG. 1.

FIG. 4 is a top plan view of the cardboard sheet with its edges in the turned up position.

FIG. 5 is a vertical section, along the line 5—5 of FIG. 6, of a protective blister type lid of transparent plastic.

FIG. 6 is a top plan view of FIG. 5.

FIG. 7 is an end view of the lid shown in FIG. 5.

FIG. 8 is a side view of the lid in an inverted position.

Figure 5:
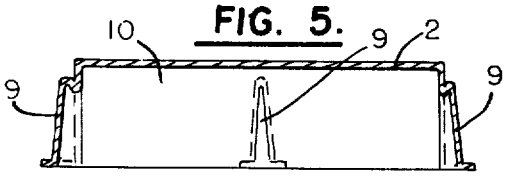
Figure 6:
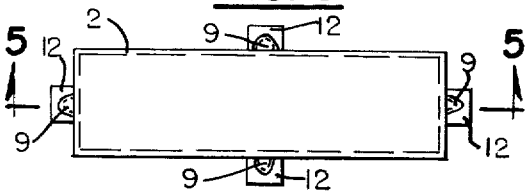
Figure 7:
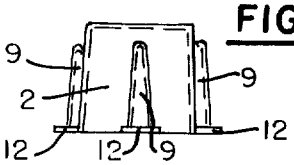
Figure 8:
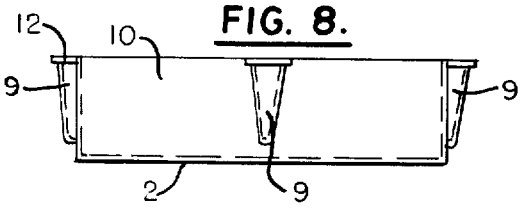
Figure 9:
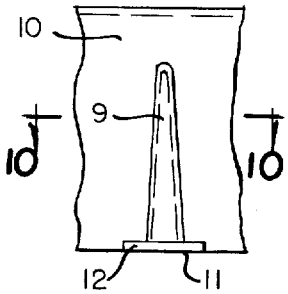
Figure 11:
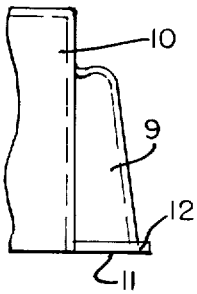
Figure 10:
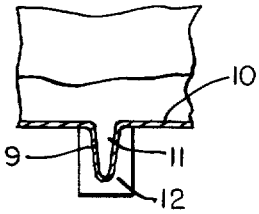

FIGS. 9 to 11, on an enlarged scale, show a tongue formed by one of the faces of the lid shown in FIG. 5, FIG. 9 being an end view. FIG. 10, a top plan view of FIG. 9, and FIG. 11, a side view.

Figure 12:
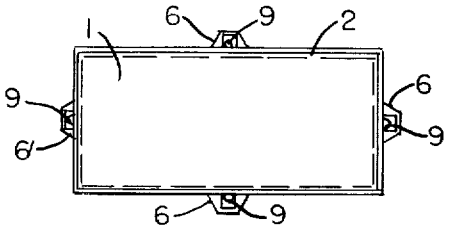
Figure 13:
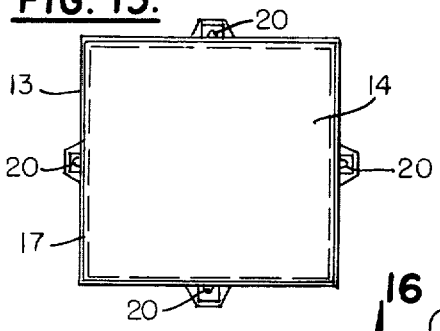

FIGS. 12 and 13, are top plan views on a reduced scale of the first two forms of execution of an assembled display carton comprising the cardboard base sheet and the blister-lid respectively, the carton in FIG. 12 being oblong in shape and that in FIG. 13 being square.

Figure 1:
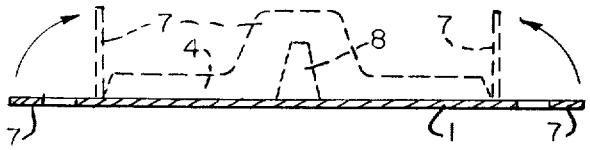
FIGS. 1 to 12 show the first form of execution of the carton.
Figure 3:
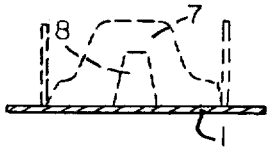
Figure 2:
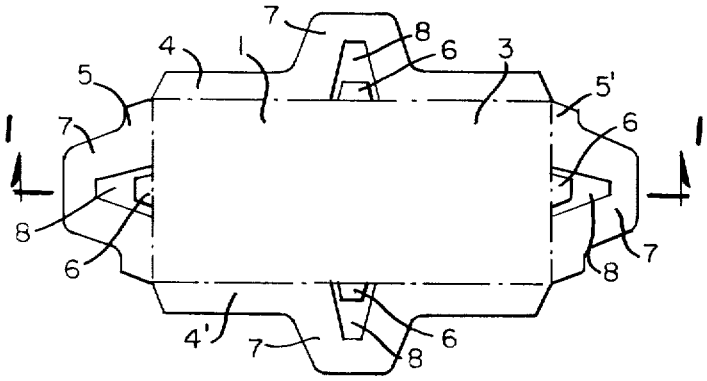
Figure 4:
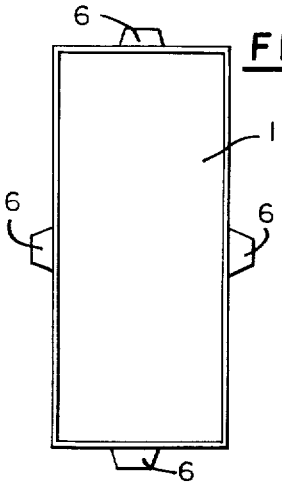
Figure 14:
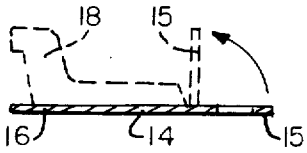
Figure 15:
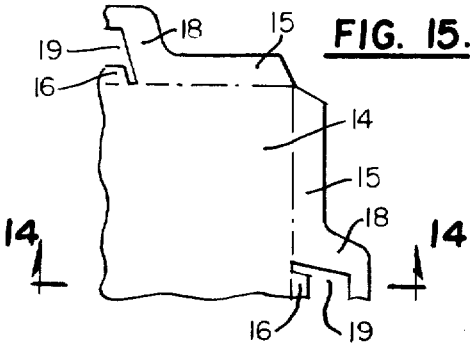

FIGS. 14 and 15 illustrate the top right-hand quarter of the cardboard base of the second form of execution shown in FIG. 13, FIG. 14 being a vertical section, along the line 14—14 of FIG. 15, and FIG. 15, being a top plan view of FIG. 14, the cardboard sheet being provided with turned up edges similar to those illustrated in FIGS. 1 and 2.

Figure 16:
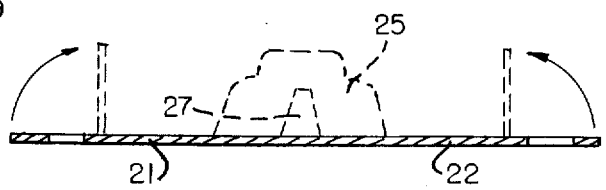
Figure 17:
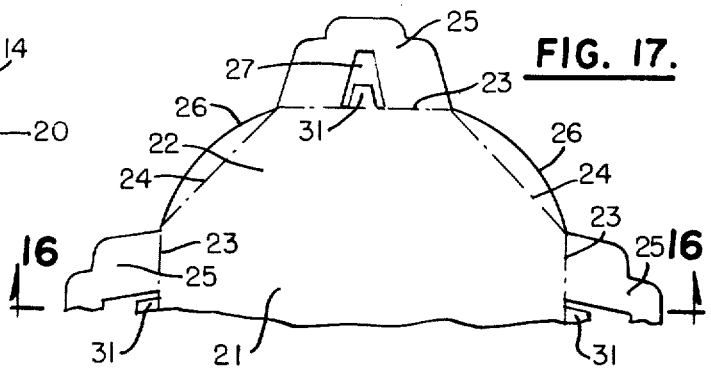
Figure 18:
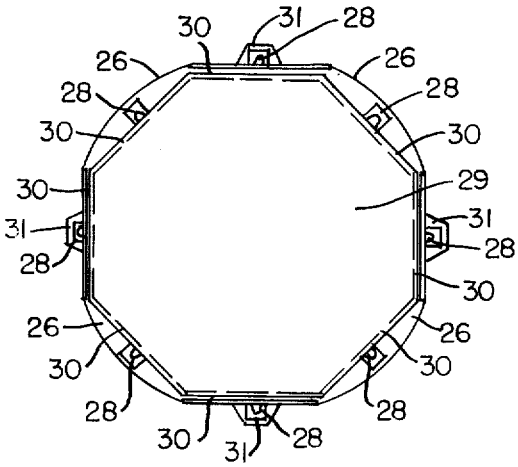

FIGS. 16 and 17 represent half of a cardboard base sheet in a third form of execution of the display carton as shown in FIG. 18, FIG. 16 being a vertical section, along the line 16—16 of FIG. 17, and FIG. 17, a being a top plan view of FIG. 16.

FIG. 18, on the same scale as that of FIGS. 12 and 13, illustrates a general top plan view of the display carton in the third form of execution with an octagonal-shaped blister-lid.

The display carton, in the first form of execution shown in FIGS. 1 to 11, comprises an oblong sheet of cardboard 1 (FIGS. 1 to 3) and a lid 2 (FIGS. 5 to 10) made of heat-moulded transparent plastic, said lid being referred to herinafter as a blister. The central part 3 (FIG. 2) of the sheet 1 is rectangular in shape, its outline being represented by dotted-chain lines. Each side of the rectangle is provided with turned up edges 4,4' for the longitudinal sides of the sheet 1, and edges 5,5' for the lateral sides.

The median part of each side of the rectangle is provided in addition with a projection 6 in the shape of an isosceles trapezium, said projection being used as a support for the corresponding side of the blister 2 provided with a tongue, 9 as shown in FIG. 12.

The median part of each turned-up edge, 4,5 of sheet 1 is provided with a tab 7 with a central slot 8, the tab and the slot being trapezoidal in shape.

On the cardboard sheet 1 (FIG. 4) rests the blister-lid 2 (FIGS. 5 to 8) made of transparent heat-moulded material. In addition, on the central part of each vertical wall forming a side of the blister 2 is situated a tongue 9 (FIGS. 9 to 11), of generally conical shape, said tongue being made by means of a cup-shaped external protuberance, from the wall 10 of the blister 2. The opening 11 in the protuberance is situated on a level with the point of contact of the blister 2 with the cardboard sheet 1. For this purpose, the opening 11 of the protuberance is reinforced by a flange 12, rectangular in shape, in order to provide a seat for the blister 2 when it is placed on the cardboard sheet 1.

The assembling of the blister 2 with the cardboard sheet 1 is effected as follows: with the blister placed and centered on the rectangular edge of the sheet 1, the four edges 4 and 4', 5 and 5' are turned up, the tongues 9 being fitted in the slots 8 on each of the four sides of the display carton, as shown in FIG. 12, this carton being intended to hold a cake.

If the merchandise contained in the display carton is a tart, a second form of execution of the carton is used, shown in FIGS. 13 to 15.

These figures show a sheet of cardboard 13, having in its central part 14 a square surface whose shape is represented partially in FIG. 15 by chain-dotted lines. Each side of the square is provided with a turned up edge 15 and the median part of each side of the square is provided, in addition, with a projection 16 in the shape of an isosceles trapezium. The projection 16 serves as a support for the corresponding side of a blister 17 (FIG. 13), the lower edges of whose vertical walls correspond to the shape of the central part 14 of the cardboard sheet 13. In addition, the median part of each turned up edge 15 is provided with a tab 18 with a central slot 19, the tab with the slot being trapezoidal in shape. The blister 17 is made in the same way as the blister 2 of the first form of execution and comprises tongues 20 similar to the tongues 9 (FIGS. 9 to 11) described above.

In a third form of execution of the product display carton, shown in FIGS. 16 to 18, the sheet of cardboard 21 forming the base on which a product is placed, the product and the blister serving comprises a central part 22, octagonal in shape, outlined by fold lines, said lines being indicated by chain-dotted lines in FIG. 17. These fold lines are subdivided into four lines 23 arranged in the form of a cross and into four lines 24 placed connecting the lines 23. Each fold line 23 separates the central part 22 from four lobes 25 respectively, of generally trapezoidal shape and capable of being turned up, the connecting lines 24 separating the central part 22 from four circular arcs 26 respectively. Each lobe 25 is provided with a central trapezoidal slot 27, intended to receive, after said lobes have been turned up, tongues 28 (FIG. 18) of the blister 29 which serves as a lid.

The octagonal shaped blister 29 comprises eight vertical walls 30, corresponding to the fold lines 23 and connecting lines 24 respectively of the cardboard sheet 21. Each vertical wall 30 is provided in its median part with a tongue 28, similar to the tongue 11 described above. The rectangular flange of said tongue resting on a trapezoidal projection 31 (FIG. 17), said projection being located so as to jut out beyond each fold line 23 of the cardboard sheet 21.

In the three forms of execution of the display carton as described, the top surface of the cardboard sheet 1,13, 21 can be printed with a decorative motif. It is also possible to calender or proof the cardboard sheet after it has been printed in order to avoid grease stains.

The carton described has in particular the advantage of being easy and quick to handle, the blister-lid being polygonal in shape and being secured in position by means of tongues protruding from the outside face of the vertical walls of the blister.

I claim:

1. A product display carton comprising in combination a cardboard base sheet of oblong configuration including fold lines to facilitate folding the edges of the sheet upwardly to define a central rectangular article receiving portion, each side of said central portion provided with a projection and a turned up edge, the median part of each of said sides including a trapezoidal shaped tab provided with a central slot, a blister of transparent heat molded plastic including a top wall, side walls and an open bottom, a tongue extending outwardly from each of said side walls and fitted into a related central slot in one of said tabs, said tongue being of generally conical shape and forming an external cup-shaped protuberance, the opening of the cup being located on a level with the edge of contact of said blister with the cardboard base sheet, the edge of said opening provided with a flange for reinforcement thereof, said flange being in contact with the projection on the cardboard base sheet.

2. A product display carton comprising in combination a cardboard base sheet of octagonal configuration including fold lines to facilitate folding the edges of the sheet upwardly to define a central octagonal article receiving portion, four of said fold lines being arranged in the shape of the arms of a cross, four additional fold lines connecting said first mentioned lines to define four lobes, said lobes being trapezoidal in shape and adapted to be turned upwardly, the four additional fold lines separating the central portion of the base sheet and four circular arc portions, each said lobe being provided with a central trapezoidal shaped slot, a blister of transparent heat molded plastic including a top wall, eight vertically extending side walls corresponding to the fold lines and connecting lines of said sheet and an open bottom, a tongue extending outwardly from each of said side walls and fitted into a related central slot in one of said lobes, said tongue being of generally conical shape and forming an external cup-shaped protuberance, the opening of the cup being located on a level with the edge of contact of said blister with the cardboard base sheet, the edge of said opening provided with a flange for reinforcement thereof, said flange being in contact with the projection on the cardboard base sheet.

3. A product display carton comprising in combination, a base sheet including fold lines to facilitate folding the edges of the sheet upwardly to define a central article receiving portion, each of the foldable edges of said sheet provided with a slot, a transparent blister conforming generally in shape to the central article receiving portion of said base sheet, said blister including a top wall, side walls and an open bottom, a tongue extending outwardly from each of said side walls and snap fitted into said slots when the base sheet and blister are in assembled relationship, said tongue being of generally conical shape and forming an external cup-shaped protuberance.

* * * * *